US006813782B2

(12) United States Patent
Kintzi et al.

(10) Patent No.: US 6,813,782 B2
(45) Date of Patent: Nov. 9, 2004

(54) SAFETY DEVICE AND SYSTEM FOR HEAD AND NECK STABILIZATION

(76) Inventors: Harry E. Kintzi, 3304 Bowman Rd., Landisville, PA (US) 17538; Martin C. Kintzi, 3304 Bowman Rd., Landisville, PA (US) 17538

( * ) Notice: Subject to any disclaimer, the term of this patent is extended or adjusted under 35 U.S.C. 154(b) by 0 days.

(21) Appl. No.: 10/328,104

(22) Filed: Dec. 23, 2002

(65) Prior Publication Data

US 2003/0115657 A1 Jun. 26, 2003

Related U.S. Application Data

(60) Provisional application No. 60/342,940, filed on Dec. 21, 2001.

(51) Int. Cl.[7] ..... A42B 7/00

(52) U.S. Cl. ..... 2/421; 2/69

(58) Field of Search ..... 2/421, 69, 79, 2/411, 425, 468, 462; 280/290, 801.1; 182/3; 244/122 AG

(56) References Cited

U.S. PATENT DOCUMENTS

| | | | | | |
|---|---|---|---|---|---|
| 2,979,153 | A | * | 4/1961 | Hoagland et al. | 182/3 |
| 3,925,822 | A | * | 12/1975 | Sawyer | 2/421 |
| 4,625,335 | A | * | 12/1986 | Vinai | 2/69 |
| 4,638,510 | A | | 1/1987 | Hubbard | |
| 4,731,882 | A | * | 3/1988 | Ekman | 2/69 |
| 4,909,459 | A | * | 3/1990 | Patterson | 244/122 AG |
| 5,272,770 | A | * | 12/1993 | Allen et al. | 2/421 |
| 6,009,566 | A | | 1/2000 | Hubbard | |
| 6,128,782 | A | * | 10/2000 | Young et al. | 2/69 |
| 6,256,789 | B1 | * | 7/2001 | Young et al. | 2/69 |
| RE37,394 | E | * | 10/2001 | Woodyard | 2/102 |
| 6,330,722 | B1 | * | 12/2001 | Betts | 2/416 |
| 6,381,758 | B1 | | 5/2002 | Roberts et al. | |
| 6,428,043 | B1 | | 8/2002 | Wooten | |
| 6,499,149 | B2 | * | 12/2002 | Ashline | 2/468 |
| 6,588,022 | B1 | * | 7/2003 | Anders et al. | 2/421 |
| 2001/0002087 | A1 | * | 5/2001 | Townsend | 280/801.1 |
| 2002/0043831 | A1 | | 4/2002 | Alsup | |

FOREIGN PATENT DOCUMENTS

| | | | | |
|---|---|---|---|---|
| DE | 4445219 A1 | * | 6/1996 | B60R/21/00 |
| WO | WO 9305986 A1 | * | 4/1993 | B60R/22/14 |

* cited by examiner

*Primary Examiner*—Rodney M. Lindsey
(74) *Attorney, Agent, or Firm*—Marc J. Farrell; Buchanan Ingersoll

(57) ABSTRACT

A helmet restraint and head and neck support system is provided for a driver of a racecar which restrains the forward, downward and lateral movement of the driver's head when subjected to large deceleration or other impact forces. The system includes a helmet for receiving the driver's head and a racing suit adapted to be worn by the body of the driver having left, right and rear straps for easily connecting and disconnecting the helmet to the racing suit. The rear strap is anatomically positioned in parallel with the driver's spine, and includes straps encircling both the arms and the legs of the driver. The protective helmet restraint and head and neck support system restrains the movement of a helmeted driver upon impact, stabilizes the posture of the head and neck of the operator during high speed maneuvers, and yet is simple and economical to fabricate and use.

20 Claims, 3 Drawing Sheets

SAFETY DEVICE AND SYSTEM FOR HEAD AND NECK STABILIZATION

CROSS-REFERENCE TO RELATED APPLICATIONS

This application claims the benefit under 35 U.S.C. § 119(e) of the earlier filing date of U.S. Provisional Patent Application Ser. No. 60/342,940 filed on Dec. 21, 2001.

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Field of the Invention

The present invention relates generally to the field of protective racing harness systems. More particularly, the present invention relates to an improved safety device for head and neck stabilization for use in high performance vehicles, such as racecars, boats, airplanes or other high-speed apparatus.

2. Description of the Related Art

Racing is a dangerous sport. Attempts to minimize the risk involved with racing have included the increased use and development of seat belts, race harnesses, nomex fireproof clothing and roll bars/cages. However, different injury patterns, and despite the use of standard safety devices, tragic injuries and deaths from head and neck injuries have continued to occur.

Helmets are widely used in vehicles and other motion apparatus for protection of the head of the driver or other occupants thereof. However, while a helmet may provide protection to a wearer's head from injuries caused by impact with foreign objects, helmets are often inadequate to prevent the violent motion of the head and the bending of the neck of the wearer caused by the momentum of a sudden impact. In sudden frontal or angled frontal decelerations, the racers protective helmet becomes a 100+ pound projectile that, instead of protecting the racer, can actually increase the severity of the resultant injuries.

U.S. Pat. No. 6,381,758 contains a thorough discussion of the forces imposed upon a driver's head during frontal impact and the fatal neurological damage that can result therefrom, the details of which are incorporated herein by reference.

In response to this problem, numerous devices have been devised. While all have some protective value, none are without shortcomings—whether it be the cost, the restrictive nature of the device (or the perceived restrictiveness), lack of comfort, difficulty in wearing or attaching the device, or the device's lack of flexibility.

It is standard today for drivers of high performance vehicles to use a five- or six-point seat belt assembly in which all straps tie into a common buckle to restrain the driver during a crash. When a racecar traveling at extreme speeds crashes into an object, such as a concrete wall for example, the body of the driver remains strapped in by the car's seat belt harness, but the driver's neck and head stretch far forward, sometimes smashing the steering wheel or going beyond the wheel. The helmet worn by the driver may protect the driver's head from injuries caused by striking the steering wheel or windshield. Unfortunately, a helmet will not prevent the driver's head from the violent forward or lateral motion caused by inertia and external forces. Such violent movements of the head and neck frequently result in traumatic and disabling injury to the spine, supporting skeletal muscles, spinal cord, and brain. In recent years, several of the world's most renown racecar drivers have been involved in crashes that resulted in serious injuries, or even death, from a skull fracture caused by violent whipping of the head. Many believe that such injuries and deaths could have been prevented had the drivers been using some type of helmet-restraint system.

One common problem with nearly all existing restraint devices is the fairly high cost associated with the purchase of a system. For the limited number of drivers competing in the top three U.S. series—Winston Cup, Grand National and Trucks—cost is not so much a factor. However, there are many other drivers who compete on a much more limited basis, and as such, often do not have the financial resources of the full-time professional racecar drivers. The relatively high cost of existing head and neck restraint devices has the effect of creating a situation whereby drivers, because of cost concerns, end up not wearing this essential safety equipment—an obviously undesirable result.

Another problem associated with existing restraint devices—particularly those that require the user to don them over or under his racing suit—is that a head and neck restraint has to be right for each individual driver. What is right for one person may not be right for another. Conversely, devices that do accommodate a wide range of body types and personal preferences require a substantial number of adjustments to be made to the device in order for the wearer to be able to don the device and/or to position himself with the car's cockpit. Such adjustments are burdensome and time consuming. Further, by increasing the number of variables that must be attended to, the chances of something critical being overlooked also increase accordingly.

The HANS Device

Of the various head-and-neck restraint systems that have emerged in recent years, one of the more popular is the Head And Neck Support or "HANS" device, produced by Hubbard-Downing, Inc. of Atlanta, Ga. The HANS device which consists essentially of a rigid collar-shaped carbon fiber shell that is held onto the driver's upper body by seat belts and fastened to the helmet with flexible nylon tethers attached to both sides of the driver's helmet—is an example of a head and neck support device that makes use of a yoke and collar arrangement.

U.S. Pat. No. 4,638,510 to Hubbard describes an earlier version of the HANS apparatus consisting of a head and neck support device with tethers that are attached between the driver's helmet and the collar of the head and neck support apparatus. The head and neck support apparatus has a yoke integral with the collar that fits around the back of the driver's shoulders, adjacent the neck, and on the front of the driver's chest. The yoke has an opening so that the driver can mount the head and neck support apparatus by placing his head through the opening. An alternate embodiment is described wherein the yoke is provided with a slot in the front so that the driver can put on the apparatus from behind by sliding the apparatus around his neck.

As Hubbard himself later admitted in a subsequent patent for an improved version of his HANS device (U.S. Pat. No. 6,009,566), the apparatus disclosed in U.S. Pat. No. 4,638, 510 was lacking in at least one respect, namely, the fact that the loading from the tethers had to be resisted by bending of the collar and yoke of the head and neck support apparatus. This required a substantial collar and yoke structure which occupied space between the bottom of the occupant's helmet and torso. As described by Hubbard in U.S. Pat. No. 6,009,566, the device of U.S. Pat. No. 4,638,510 often interfered with the bottom of the occupant's helmet.

The improved version of the HANS device is not without its own shortcomings, however. To accommodate attachment of the HANS device, fairly intricate modifications must be made to the driver's helmet. In fact, at least up until just very recently, drivers were unable themselves to attach a HANS device to their helmets. Instead, Hubbard-Downing—the sole manufacturer of the HANS device—required drivers in all cases to send their helmets to Hubbard-Downing for attachment.

Further, despite its popularity, it has been observed by some that the HANS device can be uncomfortable to wear, and sometimes gives the wearer the feeling of it not fitting properly. In addition to complaints about discomfort experienced while wearing the system, other drivers have expressed concern that getting out of the car with the hefty safety collar could be a problem, particularly when the driver needs to free himself quickly from the car, such as in the event of a fire, for example. Still others have observed a somewhat claustrophobic feeling when using the HANS device, in that the driver is essentially crammed into the car's cockpit, with the HANS device crammed up against the driver's head and crammed against the seat. In addition, during certain types of racing requiring a driver change during a pit stop where the driver exits and enters through a small opening in the cockpit, the HANS may prove somewhat cumbersome and slows the exit of the driver.

Lastly, the HANS device is not an inexpensive piece of equipment. As of December 2002, the least expensive lower-end model of the HANS device was being offered for sale at $675, with the mid-range models going for $975 and $1,275, and the high-end model retailing at $2,000.

The HUTCHENS Device

The development of the head and neck restraint device now popularly referred to as the "Hutchens Device" was started in mid-2000 by Restraint System Engineer Trevor Ashline, and is manufactured and offered for sale through Safety Solutions, Inc. of Concord, N.C. The Hutchens device differs from the U-shaped HANS in that it is only a series of belts that hook into a driver's helmet and existing seat belt system, whereas the HANS is an actual piece that goes on over the shoulders and hooks onto the helmet.

The Hutchens device is a harness system that reduces the amount of load transferred to the head and neck in angular frontal and frontal impacts. The harness does not connect to the roll cage and does not need to be taken off or unhooked from the helmet to allow the driver to exit the car in an emergency situation. However, the Hutchens device does rely upon its attachment to the car, i.e. through the connection to the car's existing lap belt buckle, as the "anchor" for the system. That is, the harness transfers load from the head to the car's existing lap belt by means of helmet tethers connected to the vertical straps on the harness. The vertical straps are then connected to the lap belt buckle. There are two vertical straps running the length of the driver's back, each one positioned approximately on top of and in line with the driver's shoulder blades.

It has been observed by some that in wearing the Hutchens device, there is not a consistent fit from one instance to the next even when it is the same driver in each instance wearing the same Hutchens device each time. That is, users who wore the Hutchens device on several different occasions have commented that each time they put on the device it was on the driver in a different way, the device never seeming to be in the same spot on the driver's body.

This lack of consistency in how the Hutchens device forms to the wearer's body can be so discomforting and such a cause for concern, particularly in the cramped quarters of a racecar during the midst of competition (where peace of mind can be critical), that some drivers would rather not wear it at all and run the risk of injury. Others have observed that they had trouble figuring out how to get in and out of the racecar with the Hutchens device's straps in place.

D-Cel or Decelerator Harness

The same company that makes the Hutchens device, Safety Solutions, has recently introduced a head and neck restraint device referred to as the D-Cel Harness. The D-Cel Harness has also been licensed to and is available from Simpson Performance Products of New Braunfels, Tex., under the name "Decelerator."

The D-Cel Harness wraps around the driver and relies on the pelvis to anchor the system. There's no neck collar like the HANS device, nor is it sewn into the driver's suit. The harness does not hook into the lap belt as the Hutchens device does. The D-Cel Harness differs from the Hutchens device in that the straps pull more from the driver's pelvis, and there are fewer adjustments needed once the driver puts the device on.

Unlike the HANS device, the Decelerator features no bulky collar that limits head motion and vision. It also features two quick release points that make it easier to climb out of the car in the event of an accident. Unlike the Hutchens device, which wraps around the driver's chest, waist and crotch and connects to the seat belts, the Decelerator features a series of straps that mount to the roll bars behind the driver's seat and run through the same route as the shoulder belts. Those straps connect to the decelerator strap, two pieces of webbing that is folded and sewn together and connects to a mount on the front of the driver's helmet. Upon impact, the stitching in the decelerator straps tear apart, slowing the acceleration and forward motion of the driver's head. The sewn straps must be replaced after a crash. Thus, unlike some restraint systems, the Decelerator works to absorb force by moving slightly with the body.

Not only must an elaborate set of instructions be followed in order to modify the driver's helmet so as to enable it to accommodate the D-Cel, but then to simply don the device requires the driver to observe the following intricate series: (1) The driver must grab the device's harness by the body and lay the leg straps on the ground by his feet, following which he must step into the leg straps and pull the harness up the legs to the pelvis; (2) the driver must then insert his arms under the device's shoulder harness and drape the device's crossed back strap over his shoulders, so the crossed straps are located in the center of his back; (3) next, the driver must adjust the back cross strap 3-bars so that the upper shoulder cross strap is located 1–2 inches below the base of the neck and the side crosses are positioned on the hips—a distance which must be measured fairly precisely, as it becomes important later in adjusting the device's helmet tethers correctly; (4) the driver next adjusts the rear 1-inch cross strap so that it will keep the crosses on the hips when the occupant sits, and then must lock down the cross strap with the devices 3-bar adjuster so that it will not slide; (5)

the leg strap 3-bar adjusters must then be adjusted around the legs; (6) following which the chest strap must be adjusted so that the upper chest straps are aligned vertically on the chest. It is only then that the driver is finally ready to get into the car (step 7), following which he must then: (8) pull down on the shoulder straps on the device's harness; (9) then seat the harness by pulling up on the back helmet tethers to take out the slack in the lower portion of the harness before adjusting the helmet tethers (tension must be felt all the way from the pelvis to the top of the harness, and the harness must be seated every time it is used); (10) next, he must pull the quick-release hook bail so as to release it, following which the quick-release hook must be attached to the double helmet hook and the bail secured (and further, the shoulder harness straps must be positioned to the outside of the vertical straps and the helmet tethers must be on the inside of the shoulder belt harnesses to provide a straight load path and to insure the harness does not get caught up in the shoulder belts in the event a quick egress is needed; also, the quick-release tether must be pointed down toward the driver for the release mechanism to work properly). This still does not end the process yet, however, as the adjustment of the helmet tethers has yet to be accomplished—a step which is critical to the proper functioning of the harness, due to the fact that the highest neck tension occurs very early in an accident and therefore, the initial tension on the harness is directly related to the effectiveness of the system. First, the rear tether must be adjusted. Proper adjustment of the harness is accomplished when a maximum forward movement of one inch is allowed before tension is felt in the harness system (which should allow approximately 20 degrees of side-to-side movement). The manufacturer suggests that drivers use extra mirrors, where allowed, in order to help eliminate blind spots. Next, the forward helmet tether is adjusted so that it restricts side movement of the helmet.

Drivers who use the D-Cel are cautioned by the manufacturer to check to insure that all latches are secure each time the harness is worn, and to "seat" the harness by pulling up on the helmet tethers before attaching the quick release to the helmet in order to take out unwanted slack in the system. Drivers are further cautioned that minor adjustments may be necessary to properly tension the harness each time the system is worn. Several factors that can influence the harness fit are identified, including: (a) the fit of the driving suit (a loose fitting driving suit will allow the harness to better fit the occupant, and will also allow the fire suit to increase its effectiveness in a fire by providing gaps); and (b) the seat and seat belt tension can also change the routing distance, thus requiring harness adjustment.

A device similar in construction to the D-Cel is the White Head and Restraint System, designed by George White of Speedway Safety Equipment, Hueytown, Ala. However, rather than straps which connect to the driver's helmet, the White device includes a yolk or webbing which the driver places on top of his head, prior to donning his helmet. The White device, unlike the D-Cel, does include a vertical strap that runs substantially along the mid-point of the driver's back, in alignment with the spine. However, this strap terminates at a point near the back of the base of the driver's neck, there being no connection anywhere in the vicinity of the back of the driver's head between the straps of the harness and either the helmet or the webbing underneath. Rather, the sole connections appear to be located on the side of the driver's head, at or around where the ears are located.

Therefore, the need exists for a head and neck restraint system for protecting racecar drivers and the like from serious or fatal head and neck injuries during a front or side impact, and yet at the same time do so without decreasing flexibility while still being compatible with all current motor sports safety equipment, comfortable to wear, affordable, and easy to use, requiring few if any adjustments from driver to driver or from race to race. Preferably, the device should not be one that the user dons separately from his racing suit, nor should it be one that requires attachment to the car's existing structure.

SUMMARY OF THE INVENTION

Accordingly, it is an objective of the present invention to provide a helmet restraint system which restrains the helmet of a racecar driver to protect the driver's head and neck from the various forces and motions that are applied while in a high performance vehicle, which would otherwise result in fatigue or injury.

Another objective of the present invention is to provide a head and neck support device for restraining forward and lateral movement of a racecar driver's helmet upon rapid deceleration and thereby reduce the shock forces encountered by the driver's head and neck during a front or side impact.

Still another object of the present invention is to provide a head and neck restraint system which is economical to manufacture and easy to use.

Another important object of the present invention is to provide such a safety harness which can be quickly and easily donned and removed from the body of the wearer.

A further object of this invention is to provide such a safety harness which allows limited freedom of movement of the driver's head and yet can be worn with comfort.

It is also an object of the present invention to provide a helmet restraint harness system that can be quickly and easily installed and attached to the existing helmet worn by an operator or occupant of a vehicle or other motion apparatus.

It is a further object of the present invention to provide a head restraint device which can be quickly and easily attached or detached from the headgear as needed using one hand.

A further object of this invention is to provide a head restraint for a racecar driver which allows limited movement of the driver's head.

It is another object of the present invention to provide a racing harness system which remains attached to the operator independent of whether the operator remains in the vehicle.

It is a further object of the invention to provide a racing harness system which is integrated into existing racing suits.

It is a further object of the invention to provide a racing harness system which does not interfere with proper use of existing safety devices such as 5- or 6-point seatbelts and removable steering wheels.

It is a further object of the present invention to provide a helmet restraint system that stabilizes the user's head and neck in an anatomically correct posture to help prevent serious injury upon a sudden impact.

It is a further object of this invention to provide a head and neck support device which is comprised of a helmet having attachment points corresponding to connector ends of a strap assembly which is incorporated into a racing suit.

Generally, there is broadly contemplated in accordance with at least one presently preferred embodiment of the present invention a helmet restraint system which comprises a strap assembly integral with a racing suit worn by a racecar driver and releasably connected to the driver's helmet adjacent the back of his neck and each of his ears.

Further, there is broadly contemplated in accordance with at least one presently preferred embodiment of the present invention a head and neck support device which includes a racing suit to which are integrally provided right, left and rear straps adapted to engage over the shoulders and neck, respectively, of the wearer and which in turn are adapted to be secured to the helmet. Arm straps are attached to the right and left strap and adapted to encircle the upper arms of the wearer. The rear strap, which runs vertically in line with the wearer's spine, has leg straps attached to it which are adapted to encircle the upper thighs of the wearer. The right, left and rear straps may be easily and quickly attached and detached to permit the helmet to be easily put on and taken off without the need for assistance from others.

The system and method of the present invention is designed to protect a racecar driver from head and neck injuries through anatomically correct posture and restraint in a racing environment. The device of the present invention addresses the restrictive nature of the HANS device, and the inadequate anatomic design and complexity of use of other known racing harnesses. This device is different from the HANS device, the Hutchens head and neck device, and other known racing harnesses in that, among other things, the system of the present invention incorporates secure harness straps which are integrated into a racing suit and which easily and removably attach to existing safety helmets.

The integration of the rear strap into the racing suit and its attachment to the back of the driver's helmet at one end and legs straps which encircle the driver's upper thighs at the other end, restrains forward motion of the helmet, head and neck resulting from frontal collision impacts. Likewise, the integration of the arm straps into the racing suit and the attachment to each of the sides of the driver's helmet at one end and arm straps which encircle the driver's upper arms at the other end, restrains lateral motion of the helmet, head and neck due to side collision impacts.

The system of the present invention is physiologically and ergonomically correct, comfortable to wear, easy to attach to and remove from the helmet and easily retrofitted to a racer's present equipment. The device of the present invention is simple to use, in that the driver need only don the racing suit, strap on the helmet, attach the connector straps to the helmet, and then enter the vehicle with no more difficulty than a driver who is not wearing a helmet restraint system.

The device of the present invention allows increased safety and protection to the racecar driver from sudden forward and lateral decelerations, while at the same time remaining simple to use without restricting or hindering the driver's necessary field-of-vision head movement or accessibility to restrictive race vehicle cockpits.

Further, the connection between the integral racing suit straps and the helmet, as described more fully below, may be accomplished by any means suitably stable to withstand the forces encountered by a front, rear or side impact, and which at the same time may be quickly and easily detached by the driver without the need for assistance from others. For example, the connection means may be a latching system for seat belts, such as latch/lever connection or a cam lock connection. Variations on this general scheme are contemplated within the knowledge of one skilled in these arts.

Finally, the present invention relates to a method for providing neck protection of an occupant of a high performance vehicle while wearing a helmet, which comprises providing a racing suit including lateral and rear straps relative to the occupant which are configured to releasably attach the racing suit to the occupant's helmet.

The present invention, in its various embodiments, addresses one or more limitations in prior art helmet restraints and head and neck stabilizing systems. Various other objectives and advantages of the present invention will become apparent to those skilled in the art through the following description of the invention, the attached drawings and the claims.

BRIEF DESCRIPTION OF THE DRAWINGS

For the present invention and its presently preferred embodiments to be clearly understood and readily practiced, the present invention will be described by way of reference to the detailed disclosure herebelow in conjunction with the following figures, wherein like reference characters designate the same or similar elements, which figures are incorporated into and constitute a part of the specification, wherein.

DETAILED DESCRIPTION OF THE PRESENTLY PREFERRED EMBODIMENTS OF THE INVENTION

Figure 1:
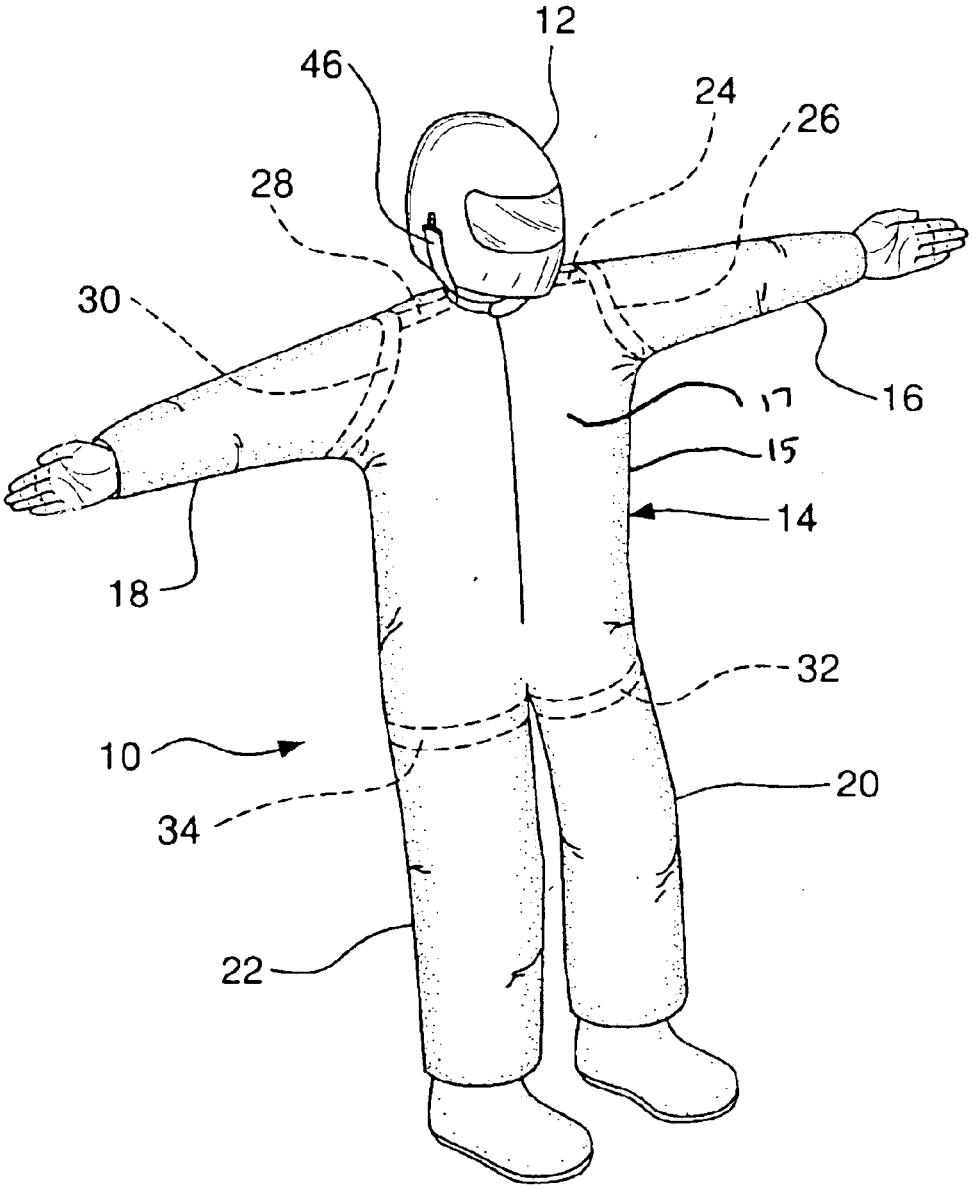
FIG. 1 is a front perspective view of the helmet restraint and head and neck support system according to the principles of an exemplary embodiment of the present invention.

It is to be understood that the figures and descriptions of the present invention have been simplified to illustrate elements that are relevant for a clear understanding of the present invention, while eliminating, for purposes of clarity, other elements that may be well known. Those of ordinary skill in the art will recognize that other elements are desirable and/or required in order to implement the present invention. However, because such elements are well known in the art, and because they do not facilitate a better understanding of the present invention, a discussion of such elements is not provided herein. The detailed description will be provided hereinbelow with reference to the attached drawings. Further, throughout the instant disclosure, it will be appreciated that several terms may be used interchangeably with one another.

If not otherwise stated herein, any and all patents, patent publications, articles and other printed publications discussed or mentioned herein are hereby incorporated by reference as if set forth in their entirety herein.

In describing the presently preferred embodiments of the invention, the terms "horizontal" and "vertical" refer to the orientation of the device as illustrated in the accompanying drawings.

Described generally, the present invention is a helmet restraint device and head and neck support system for use with a helmet worn by an operator or occupant of a vehicle. The invention comprises a novel multi-point strap assembly which is fixedly attached to a racing suit and removably connected to multiple attachment points on the operator's helmet.

FIGS. 1-4 illustrate an exemplary embodiment according to the principles of the present invention. Referring now more particularly to the accompanying drawings, and initially to FIGS. 1 and 2, the reference numeral 10 generally designates a person which in the present instance is a racecar driver, shown wearing a conventional type of safety helmet 12 applied to the head. Driver 10 is wearing a racing suit 14 which includes the helmet restraint device of the present invention. Racing 14 comprises an upper torso section 15 comprised of a front chest portion 17 and a rear back portion 19. When driver 10 dons racing suit 14, it is positioned on the driver's body such that front portion 17 is adjacent the driver's chest and the rear portion 19 is adjacent the driver's back. Extending from upper torso section 15 of racing suit 14 are left sleeve 16, right sleeve 18, left pant leg 20 and right pant leg 22.

Figure 2:
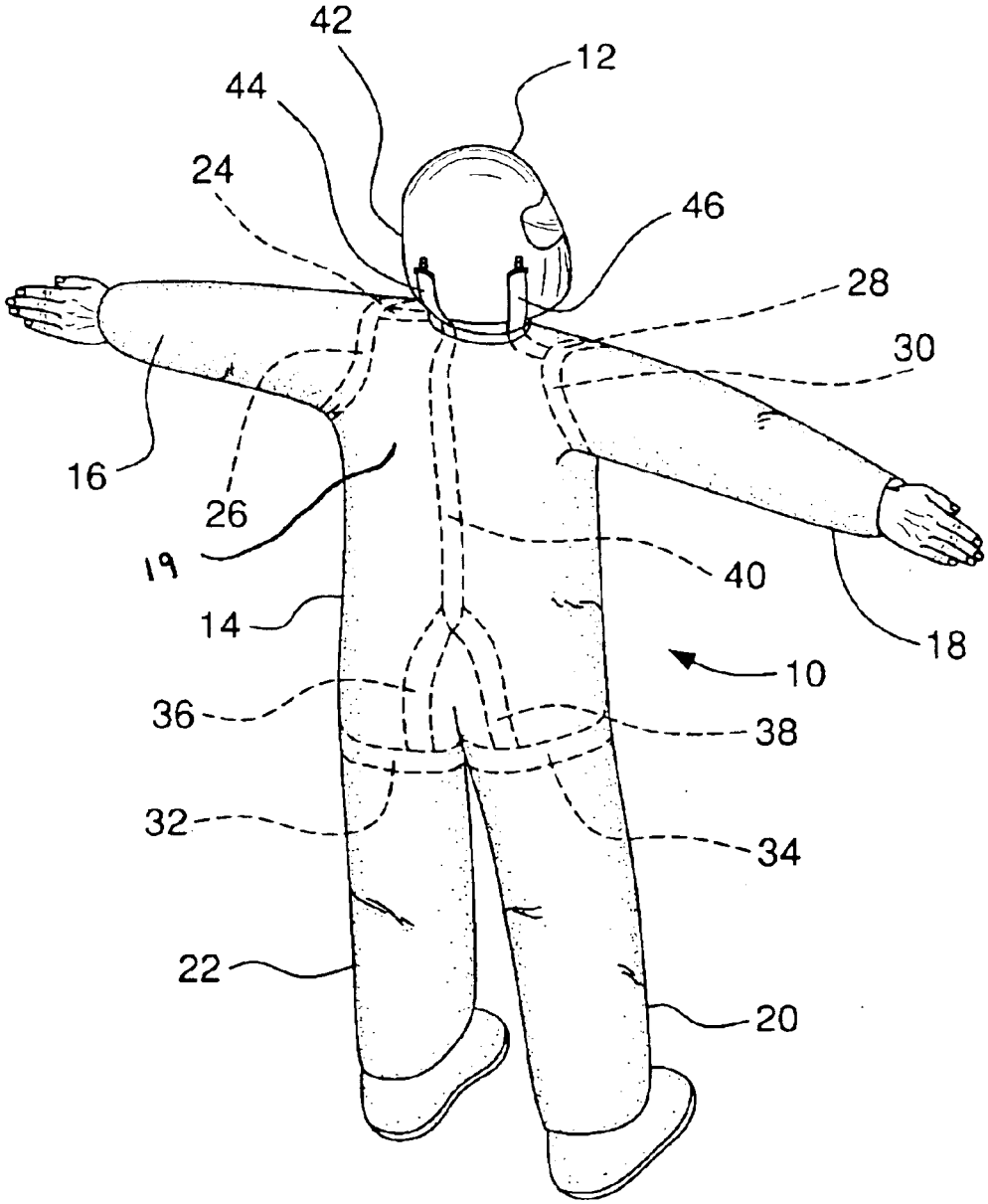
FIG. 2 is a rear perspective view of the helmet restraint and head and neck support system of FIG. 1.

As best illustrated in FIG. 2, the head and neck support system of the present invention comprises a plurality of straps 24, 26, 28, 30, 32, 34, 36, 38, 40, 42, 44 and 46, which are integral with or otherwise affixed to racing suit 14. These straps may be permanently affixed to racing suit 14 on either the exterior or interior surface of racing suit 14, or even within layers to the extent racing suit 14 consists of a multi-layer article (such as, for example, a suit with a fireproof outer layer and an insulating inner layer, in between which could be positioned the straps of the present invention). The straps could be installed using any combination of the foregoing as well, with some straps on the inside, some straps on the outside, and some straps in the middle. In the preferred embodiment, as shown in FIGS. 1-4, the straps are positioned substantially on the interior surface of racing suit 14. It is thought that making the straps less visible contributes to the user's comfort level, and thus, increases the willingness to use the device. The straps may be integrated with racing suit 14 at the time of its manufacture, or may be added to racing suit 14 subsequent to manufacture, such as, for example, by sewing the various straps onto the exterior or preferably the interior of an existing racing suit 14. Any suitable means known in the art for fixedly attaching the straps to racing suit 14 may be used.

The straps are preferably wide enough to be comfortable and of sufficient strength to protect against severe forward motion or lateral motion of a helmet undergoing sudden deceleration. The straps may be constructed of a conventional seatbelt-type woven material such as nylon or Dacron. In a preferred embodiment, the straps are comprised of nylon webbing. The present invention is not limited to straps, however, as any strong material, including but not limited to ropes, webbing, or wires, may be used in place of, or in combination with, straps.

Figure 3:
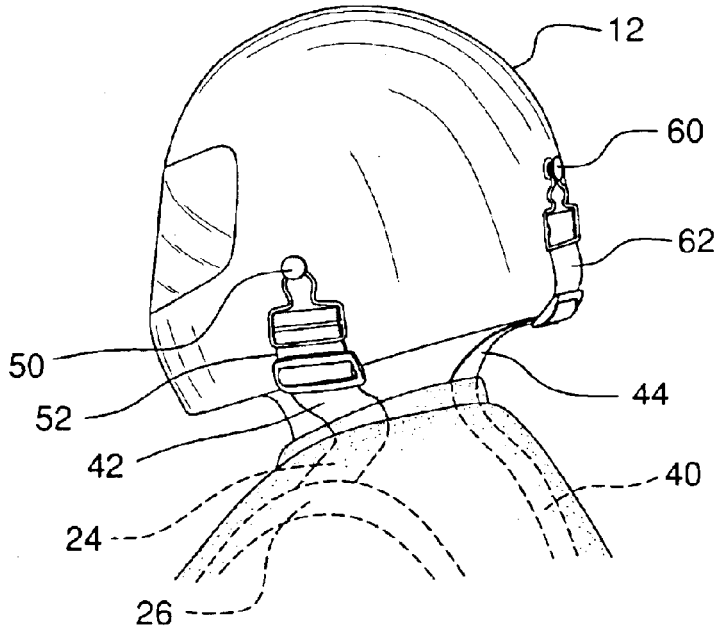
FIG. 3 is a left side elevational view of the helmet restraint and head and neck support system of FIG. 1, particularly illustrating the attachment of left connector strap 42 and left buckle 52 to left attachment means 50 on helmet 12.
Figure 4:
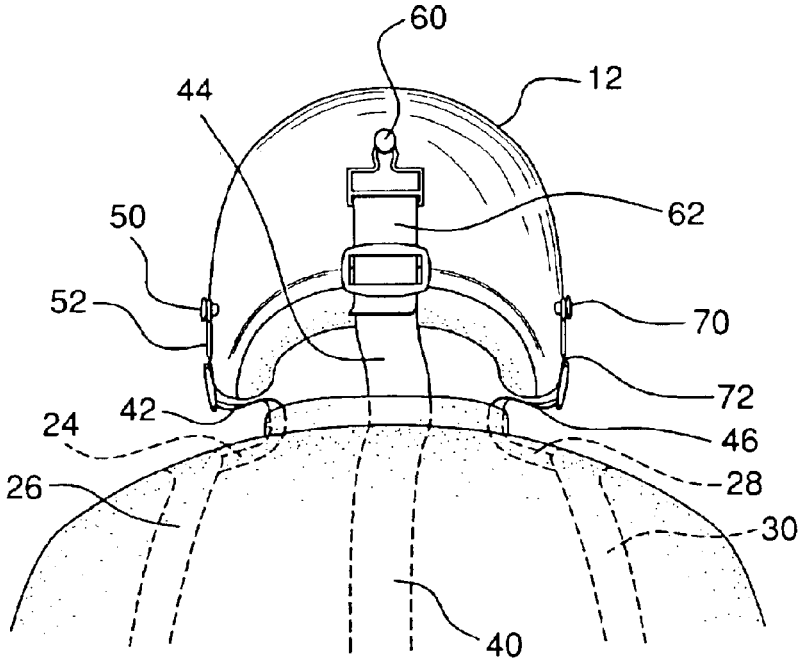
FIG. 4 is a rear elevational view of the helmet restraint and head and neck support system of FIG. 1, particularly illustrating the attachment of rear connector strap 44 and rear buckle 62 to rear attachment means 60 on helmet 12.

Helmet 12 is a standard racing helmet which has been modified with a plurality of attachment means for releasably attaching one or more of the straps from racing suit 14 to helmet 12. In the preferred embodiment, as shown in FIGS. 3-4, helmet 12 includes at least three attachment means, including right attachment means 70 on the lower side of helmet 12 (in approximate spatial relation to the right ear of driver 10 when wearing helmet 12), left attachment means 50 on the lower left side of helmet 12 (in approximate spatial relation to the left ear of driver 10 when wearing helmet 12) and rear attachment means 60 near the midpoint of the bottom edge of the back of helmet 12 (in approximate spatial relation to the top of the back of the neck of driver 10 when wearing helmet 12). While the drawings are illustrative, the scope of the invention contemplates that the number and position of helmet points of attachment may be altered to maintain proper anatomical head and spine posture based upon the driver's individual anatomy, the type of racing, speed of anticipated impact, and other relevant factors known to those skilled in the art.

Spinal strap 40 is fixed to back portion 19 of racing suit 14 so that when donned by driver 10, the upper end of spinal strap 40 is positioned adjacent the base of the neck and the lower end of spinal strap 40 is positioned adjacent the base of the spine relative to driver 10. In this manner, spinal strap 40 extends vertically from its upper end to its lower end in parallel with the spine of driver 10 when wearing racing suit 14.

As shown best in FIGS. 3 and 4, a rear connector means is attached to the upper end of spinal strap 40 and extends upwardly therefrom, the rear connector means being adapted for releasable attachment to helmet 12 near the midpoint of the bottom edge of the back of helmet 12. The term "connector means" includes any means by which spinal strap 40 and left and right shoulder straps 24, 28 are releasably attached to helmet 12. In the preferred embodiment depicted in FIGS. 1-4, for example, the combination of rear connector strap 44 and rear buckle 62 comprises the rear "connector means." Similarly, the combination of right connector strap 46 and right buckle 72 comprises the right "connector means," and the combination of left connector strap 42 and left buckle 52 comprises the left "connector means."

In the preferred embodiment, the head and neck support system also includes left shoulder strap 24 and right shoulder strap 28, each including first and second ends, fixed to upper torso section 15 of racing suit 14. Shoulder straps 24, 28 are configured to lie across the shoulders of driver 10 when wearing the device. A right connector means is attached to the first end of right shoulder strap 28, and extends upwardly therefrom. The right connector means, comprised in the embodiment shown in FIGS. 1-4 of right connector strap 46 and right buckle 72, is adapted for releasable attachment to the right side of helmet 12. Similarly, a left connector means is attached to the first end of left shoulder strap 24, and extends upwardly therefrom. The left connector means, comprised in the embodiment shown in FIGS. 1-4 of left connector strap 42 and left buckle 52, is adapted for releasable attachment to the left side of helmet 12.

Attached to the second end of right shoulder strap 28 is right arm strap 30. Right arm strap 30 is fixed to right sleeve 18 of racing suit 14. Right arm strap 30 is configured to encircle a portion of the right arm of driver 10, such that when driver 10 dons racing suit 14, right arm strap 30 is positioned relative to the driver preferably in the vicinity of the driver's armpit, but could be as low as the driver's bicep area or lower. Similarly, attached to the second end of left shoulder strap 24 is left arm strap 26. Left arm strap 26 is fixed to left sleeve 16 of racing suit 14. Left arm strap 26 is configured to encircle a portion of the left arm of driver 10, such that when driver 10 dons racing suit 14, left arm strap 26 is positioned relative to the driver preferably in the vicinity of the driver's armpit, but could be a low as the driver's bicep area or lower.

During a right lateral impact, the connection of right arm strap 30 to right shoulder strap 28, and in turn right shoulder strap 28 to helmet 12, serves to restrain the head and neck of driver 10 from moving laterally to the left, and during a left lateral impact the connection of left arm strap 26 to left shoulder strap 24, and in turn left shoulder strap 24 to helmet 12, serves to restrain the head and neck of driver 10 from moving laterally to the right. That is, the looping of arm straps 26, 30 under each arm and their respective connection to helmet 12 via shoulder straps 24, 28 in this embodiment aids in maintaining tension in shoulder straps 24, 28 and thus restrains the operator's head and spine position from extreme lateral motion.

In the preferred embodiment, the head and neck support system also includes left leg strap 36 and right leg strap 38 each of which is fixed to racing suit 14 and has first and second ends. The first ends of leg straps 36, 38 are each connected to the lower end of spinal strap 40 and extend downwardly from there to form a generally inverted Y-shape. In that manner, leg straps 36, 38 are configured to lie across the buttocks of driver 10 when wearing the device.

Attached to the second end of right leg strap 38 is right thigh strap 34. Right thigh strap 34 is fixed to right pant leg 22 of racing suit 14. Right thigh strap 34 is configured to encircle a portion of the right thigh of driver 10, such that when driver 10 dons racing suit 14, right thigh strap 34 is positioned relative to the driver preferably in the vicinity of the driver's crotch, but could be as low as the midpoint between the driver's crotch and the driver's knee or lower. Similarly, attached to the second end of left leg strap 36 is left thigh strap 32. Left thigh strap 32 is fixed to left pant leg 20 of racing suit 14. Left thigh strap 32 is configured to encircle a portion of the left thigh of driver 10, such that when driver 10 dons racing suit 14, left thigh strap 32 is positioned relative to the driver preferably in the vicinity of the driver's crotch, but could be as low as the midpoint between the driver's crotch and the driver's knee or lower.

During a frontal impact, the connection of left and right thigh straps 32, 34 to left and right leg straps 36, 38, which in turn are indirectly connected to helmet 12 via their connection with the lower end of spinal strap 40, serves to restrain the head and neck of driver 10 from moving forward and downward. In particular, the weight of driver 10 sitting on leg straps 36, 38 and thigh straps 32, 34 and the alignment of spinal strap 40 with the driver's spine, is such that additional forward restraint of the driver's head and neck is provided during a frontal impact.

In a slightly different version of the foregoing embodiment, a single spinal strap 40 extends vertically from rear attachment means 60 on helmet 12 downward to racing suit 14 and then along back portion 19 in parallel with the driver's spine, until reaching a point at the base of the driver's spine where the spinal strap is forked at its lower end, with each forked portion extending downwardly across the buttocks and along the back of each leg to a point at which it attaches to a loop which passes around the driver's legs for secure positioning. In this embodiment, the weight of the seated driver provides secure positioning of spinal strap 40 and its connection with helmet 12 in alignment with the driver's spine. Even if the operator were to become unseated during an impact, the attachment of the forked rear straps to loops around each leg will help to maintain the rear strap tension and thus restrain the operator's head and spine position from extreme forward motion.

In the seated and strapped race position, the protective nature of the straps is reinforced by shoulder straps 24, 28 and arm straps 26, 30 fixed to racing suit 14. Even if the vehicle's shoulder belt would loosen or was not attached, left arm strap 26 and right arm strap 30 under each arm ensures that helmet 12 will not distract the head from the cervical spine in a side impact. Likewise, in a frontal deceleration, spinal strap 40 and leg and thigh straps 32, 34, 36 and 38 which the driver sits on follow the body's natural vertebral alignment and prevent the helmet from distracting the head in the frontal plane. Thus, the restraining benefits of the present invention are independent of the car's safety harness, although certainly the car's properly secured harness adds to the restraining force of the device of the present invention.

The points on helmet 12 which correspond to connector straps 42, 44 and 46 comprise attachment means 50, 60 and 70, which may be any secure and strong, yet readily detachable connectors. Without limiting the scope of the invention, rivets, snap rings, wire loops, cotter pins, and other connectors known to those skilled in the art may be utilized as connectors. The connectors may optionally facilitate swiveling at the helmet points of connection to allow the operator a reasonable range of head and neck motion during routine operation of the vehicle.

The attachment between the spinal strap 40 and rear attachment means 60 (and likewise, between shoulder strap 24, 28 and attachment means 50, 70, respectively) should be such that attachment or detachment can be easily and readily accomplished by the operator without assistance from other persons. This may be include any suitable means known in the art for creating a durable, yet manually releasable, connection. In the preferred embodiment, a quick-release mechanism is employed. However, it should be apparent that other connection mechanisms could be used.

For example, rear attachment means 60 for connecting helmet 12 to spinal strap 40 may comprise a releasable receiver latch (such as, for example, a conventional seatbelt-type latch and belt mounting bracket or ring) which is molded, bolted, tethered or otherwise fixedly connected to helmet 12 to releasably receive spinal strap 40 by means of a mating rear buckle 62 fixed to the adjacent end of rear connector strap 44. Of course, the relative male-female relationships between the bracket portion and the buckle portion of the attachment means and the connector means can be reversed. That is, in the foregoing example rear buckle 62—instead of being attached to rear connector strap 44—may be mounted, tethered or otherwise connected to helmet 12, and the receiver latch which served as the rear attachment means 60—instead of being mounted to helmet 12—may be attached to rear connector strap 44.

It should be understood that spinal strap 40 and rear connector strap 44 may be two separate and discrete straps attached to one another, or may be one continuous strap—there being no true dividing point between where spinal strap 40 ends and rear connector strap 44 begins. The same holds true for right shoulder strap 28 vis-à-vis right connector strap 46, and left shoulder strap 24 vis-à-vis left connector strap 42.

While the preferred embodiment discussed herein and depicted in the drawings has means for preventing both frontal and lateral movement of the helmet, it is to be understood that both need not present in order to fall within the scope of the present invention. It is possible to omit the lateral restraint means of the present invention and make use solely of the frontal restraint means (comprising leg straps 36, 38, thigh straps 32, 34 and spinal strap 40 connected to rear attachment means 60 on helmet 12 via rear connector strap 44), or alternatively to make use of some other form of lateral restraint means in combination with the frontal restraint means of the present invention. Similarly, it is possible to omit the frontal restraint means of the present invention and make use solely of the lateral restraint means (comprising shoulder straps 24, 28 and arm straps 26, 30 connected to attachment means 44, 50 on helmet 12 via connector straps 42, 46), or alternatively to make use of some other form of frontal restraint means in combination with the lateral restraint means of the present invention.

One of the advantages of the present invention over existing helmet restraint devices is that it is simple to install and use. Further, once the system of the present invention is set to a particular driver's dimensions and preferences, and because the same driver is typically going to wear the same suit and the same helmet from race to race, the number of variables to address is reduced or eliminated altogether. Thus, while initial adjustments may be necessary the first time a driver uses the head and neck support system of the present invention, once those initial adjustments are made there should be no need to make further adjustments when the driver wears the device on subsequent occasions. Initial adjustments that may be made include, in the example where the connector means comprise a seat-belt like connector, adjustment of the length of the straps so as to provide the optimum amount of tension among the various straps which extend from racing suit 14 to helmet 12.

The present invention achieves simplicity by making use of the human body's natural design, and by incorporating into the racing suit a system of straps that attach to the helmet with quick release latches. Ease of use in turn contributes directly to the desirability of, and willingness to use, any device, which is significant when the goal is to encourage the use of safety equipment designed to prevent or minimize the serious injuries and deaths associated with auto racing.

Another advantages of the present invention is its relative affordability. The "off-the-shelf" availability of the pieces needed to make the system, and the ease of retrofitting the system to current helmets and suits, results in a helmet restraint system that is economical to manufacture and use, even for those part-time racers with limited financial resources.

The system and method of the preferred embodiment promotes proper anatomical positioning of the helmet restraint device, and prevents the racing suit and integral strap assembly from sliding or creeping—a problem which is inherent in existing racing harnesses. Moreover, in this embodiment, wearing of the device is virtually assured, since every racer in an organized or sanctioned event is required to wear a racing suit and a helmet.

If not otherwise stated herein, it may be assumed that all components and/or processes described heretofore may, if appropriate, be considered to be interchangeable with similar components and/or processes disclosed elsewhere in the specification, unless an express indication is made to the contrary.

It should be appreciated that the apparatus and method of the present invention may be configured and conducted as appropriate for any context at hand. The embodiments described above are to be considered in all respects only as illustrative and not restrictive. All changes which come within the meaning and range of equivalency of the claims are to be embraced within their scope.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims.

Nothing in the above description is meant to limit the present invention to any specific materials, geometry, or orientation of parts. Many part/orientation substitutions are contemplated within the scope of the present invention. The embodiments described herein were presented by way of example only and should not be used to limit the scope of the invention.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered by way of example only to facilitate comprehension of the invention and should not be construed to limit the scope thereof.

Although specific embodiments of the present invention have been described herein, with particular reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted.

What is claimed is:

1. A helmet restraint device for a vehicle seat occupant wearing a helmet having right and left sides and a back having a bottom edge, comprising:

a racing suit having an torso section from which right and left sleeves and right and left pant legs extend, said torso section having a chest portion and a rear portion relative to said occupant when said device is worn by said occupant;

a plurality of straps fixed to said racing suit and adapted for releasable attachment to said helmet;

wherein at least one of said plurality of straps comprises a spinal strap fixed to said rear portion of said racing suit, said spinal strap having an upper end located adjacent the base of the neck relative to said occupant and a lower end located adjacent the base of the spine relative to said occupant and extending vertically from said upper end to said lower end so as to parallel the spine of said occupant when said device is worn by said occupant;

and a rear connector means attached to said upper end of said spinal strap and extending upwardly therefrom, said rear connector means being adapted for releasable attachment to said helmet near the midpoint of said bottom edge of said back of said helmet.

2. The helmet restraint device of claim 1, wherein said rear connector means comprises a rear connector strap extending from said spinal strap at one end and having attached to the opposite end a mating buckle for engaging a releasable receiver latch on said helmet.

3. The helmet restraint device of claim 1, further comprising: means for preventing lateral movement of said helmet and said occupant's head and neck.

4. The helmet restraint device of claim 3, wherein said means for preventing lateral movement comprises:

right and left shoulder straps fixed to said racing suit, each having first and second ends and configured to lie across the shoulders of said occupant when said device is worn by said occupant;

a right connector means attached to said first end of said right shoulder strap and extending upwardly therefrom, said right connector means being adapted for releasable attachment to said right side of said helmet; and a left connector means attached to said first end of said left shoulder strap and extending upwardly therefrom, said left connector means being adapted for releasable attachment to said left side of said helmet;

wherein during a right lateral impact said right shoulder strap connected to said helmet restrains the head and neck of said occupant from moving laterally to the left, and during a left lateral impact said left shoulder strap restrains the head and neck of said occupant from moving laterally to the right.

5. The helmet restraint device of claim 4, further comprising:

a right arm strap attached to said second end of said right shoulder strap and fixed to said right sleeve of said racing suit, said right arm strap being configured to encircle a portion of said occupant's right arm when said device is worn by said occupant; and a left arm strap attached to said second end of said left shoulder strap and fixed to said left sleeve of said racing suit, said left arm strap being configured to encircle a portion of said occupant's left arm when said device is worn by said occupant.

6. The helmet restraint device of claim 5, further comprising:

right and left leg straps fixed to said racing suit, each having first and second ends, said first ends being connected to the lower end of said spinal strap and extending downwardly therefrom to form a generally inverted Y-shape, said leg straps being configured to lie across the buttocks of said occupant when said device is worn by said occupant;

wherein during a frontal impact the weight of said occupant sitting on said right and left leg straps connected to said spinal strap restrains the head and neck of said occupant from moving forward during a frontal impact.

7. The helmet restraint device of claim 6, further comprising:

a right thigh strap attached to said second end of said right leg strap and fixed to said right pant leg of said racing suit, said right thigh strap being configured to encircle a portion of said occupant's right thigh when said device is worn by said occupant; and a left thigh strap attached to said second end of said left leg strap and fixed to said left pant leg of said racing suit, said left thigh strap being configured to encircle a portion of said occupant's left thigh when said device is worn by said occupant.

8. A head and neck support system for a vehicle seat occupant, comprising:

a helmet having right and left sides and a back having a bottom edge;

a racing suit having an torso section from which right and left sleeves and right and left pant legs extend, said torso section having a chest portion and a rear portion relative to said occupant when said device is worn by said occupant;

a plurality of straps fixed to said racing suit and adapted for releasable attachment to said helmet;

wherein at least one of said plurality of straps comprises a spinal strap fixed to said rear portion of said racing suit, said spinal strap having an upper end located adjacent the base of the neck relative to said occupant and a lower end located adjacent the base of the spine relative to said occupant and extending vertically from said upper end to said lower end so as to parallel the spine of said occupant when said device is worn by said occupant; and a rear connector means attached to said upper end of said spinal strap and extending upwardly therefrom, said rear connector means being adapted for releasable attachment to said helmet near the midpoint of said bottom edge of said back of said helmet.

9. The head and neck support system of claim 8, wherein said rear connector means comprises a rear connector strap extending from said spinal strap at one end and having attached to the opposite end a mating buckle for engaging a releasable receiver latch on said helmet.

10. The head and neck support system of claim 8, further comprising:

means for preventing lateral movement of said helmet and said occupant's head and neck.

11. The head and neck support system of claim 10, wherein said means for preventing lateral movement comprises:

right and left shoulder straps fixed to said racing suit, each having first and second ends and configured to lie across the shoulders of said occupant when said device is worn by said occupant;

a right connector means attached to said first end of said right shoulder strap and extending upwardly therefrom, said right connector means being adapted for releasable attachment to said right side of said helmet; and a left connector means attached to said first end of said left shoulder strap and extending upwardly therefrom, said left connector means being adapted for releasable attachment to said left side of said helmet;

wherein during a right lateral impact said right shoulder strap connected to said helmet restrains the head and neck of said occupant from moving laterally to the left, and during a left lateral impact said left shoulder strap restrains the head and neck of said occupant from moving laterally to the right.

12. The head and neck support system of claim 11, further comprising:

a right arm strap attached to said second end of said right shoulder strap and fixed to said right sleeve of said racing suit, said right arm strap being configured to encircle a portion of said occupant's right arm when said device is worn by said occupant; and a left arm strap attached to said second end of said left shoulder strap and fixed to said left sleeve of said racing suit, said left arm strap being configured to encircle a portion of said occupant's left arm when said device is worn by said occupant.

13. The head and neck support system of claim 12, further comprising:

right and left leg straps fixed to said racing suit, each having first and second ends, said first ends being connected to the lower end of said spinal strap and extending downwardly therefrom to form a generally inverted Y-shape, said leg straps being configured to lie across the buttocks of said occupant when said device is worn by said occupant;

wherein during a frontal impact the weight of said occupant sitting on said right and left leg straps connected to said spinal strap restrains the head and neck of said occupant from moving forward during a frontal impact.

14. The head and neck support system of claim 13, further comprising:

a right thigh strap attached to said second end of said right leg strap and fixed to said right pant leg of said racing suit, said right thigh strap being configured to encircle a portion of said occupant's right thigh when said device is worn by said occupant; and a left thigh strap attached to said second end of said left leg strap and fixed to said left pant leg of said racing suit, said left thigh strap being configured to encircle a portion of said occupant's left thigh when said device is worn by said occupant.

15. A method for providing head and neck protection of an occupant of a high performance vehicle wearing a helmet, which comprises:

providing a helmet having right and left sides and a back having a bottom edge relative to said occupant on the head of the occupant, said helmet having a plurality of attachment means fixed thereto, at least one of which comprises a rear attachment means near said bottom edge of said back of said helmet;

providing a racing suit having a torso section from which right and left sleeves and right and left pant legs extend, said torso section having a front portion and a rear portion relative to said occupant, said racing suit having a plurality of straps fixed thereto, wherein at least one of said straps comprises a spinal strap having an upper end located adjacent the base of the neck relative to said occupant and a lower end located adjacent the base of the spine relative to said occupant and extending vertically from said upper end to said lower end so as to parallel the spine of said occupant when said device is worn by said occupant, said spinal strap including a rear connector strap extending from said upper end and adapted to be releasably attached to said helmet;

positioning said racing suit on the body of said occupant such that said front portion of said racing suit is adjacent the chest of said occupant, said rear portion is adjacent the back of said occupant, and said spinal strap is adjacent the spine of said occupant;

positioning the helmet on the head of the occupant; and connecting said plurality of straps to said plurality of attachment means, including said rear connector strap to said rear connector means, wherein in normal vehicle operation or in a crash said helmet connected to said racing suit reduces the forward and lateral movement of the head and neck which cause fatigue and injury in vehicle operation or in a crash.

16. The method of claim 15, further comprising:

providing means for preventing lateral movement of said helmet and said occupant's head and neck.

17. The method of claim 16, wherein said means for preventing lateral movement comprises further comprises:

right and left shoulder straps fixed to said racing suit, each having first and second ends and configured to lie across the shoulders of said occupant when said device is worn by said occupant;

a right connector means attached to said first end of said right shoulder strap and extending upwardly therefrom, said right connector means being adapted for releasable attachment to said right side of said helmet; and a left connector means attached to said first end of said left shoulder strap and extending upwardly therefrom, said left connector means being adapted for releasable attachment to said left side of said helmet;

wherein during a right lateral impact said right shoulder strap connected to said helmet restrains the head and neck of said occupant from moving laterally to the left, and during a left lateral impact said left shoulder strap restrains the head and neck of said occupant from moving laterally to the right.

18. The method of claim 17, wherein said racing suit further comprises:

a right arm strap attached to said second end of said right shoulder strap and fixed to said right sleeve of said racing suit, said right arm strap being configured to encircle a portion of said occupant's right arm when said device is worn by said occupant; and a left arm strap attached to said second end of said left shoulder strap and fixed to said left sleeve of said racing suit, said left arm strap being configured to encircle a portion of said occupant's left arm when said device is worn by said occupant.

19. The method of claim 18, wherein said racing suit further comprises:

right and left leg straps fixed to said racing suit, each having first and second ends, said first ends being connected to the lower end of said spinal strap and extending downwardly therefrom to form a generally inverted Y-shape, said leg straps being configured to lie across the buttocks of said occupant when said device is worn by said occupant;

wherein during a frontal impact the weight of said occupant sitting on said right and left leg straps connected to said spinal strap restrains the head and neck of said occupant from moving forward during a frontal impact.

20. The method of claim 19, wherein said racing suit further comprises:

a right thigh strap attached to said second end of said right leg strap and fixed to said right pant leg of said racing suit, said right thigh strap being configured to encircle a portion of said occupant's right thigh when said device is worn by said occupant; and a left thigh strap attached to said second end of said left leg strap and fixed to said left pant leg of said racing suit, said left thigh strap being configured to encircle a portion of said occupant's left thigh when said device is worn by said occupant.

* * * * *